US010319282B2

(12) United States Patent
Yang et al.

(10) Patent No.: US 10,319,282 B2
(45) Date of Patent: Jun. 11, 2019

(54) GATE DRIVING CIRCUIT, AN ARRAY SUBSTRATE AND A METHOD FOR RECOVERING THE SAME

(71) Applicants: BOE Technology Group Co., Ltd., Beijing (CN); Hefei Xinsheng Optoelectronics Technology Co., Ltd., Anhui (CN)

(72) Inventors: Tong Yang, Beijing (CN); Tingting Zhao, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 100 days.

(21) Appl. No.: 15/246,840

(22) Filed: Aug. 25, 2016

(65) Prior Publication Data

US 2017/0256196 A1 Sep. 7, 2017

(30) Foreign Application Priority Data

Mar. 4, 2016 (CN) ..... 2016 1 0124267

(51) Int. Cl.
*G09G 3/20* (2006.01)

(52) U.S. Cl.
CPC ... *G09G 3/2092* (2013.01); *G09G 2310/0267* (2013.01); *G09G 2310/0286* (2013.01); *G09G 2330/08* (2013.01)

(58) Field of Classification Search
CPC .... G09G 3/006; G09G 3/3677; G09G 3/3648; G09G 3/3688; G09G 2300/0408;
(Continued)

(56) References Cited

U.S. PATENT DOCUMENTS

| | | | | |
|---|---|---|---|---|
| 8,179,360 | B2 | 5/2012 | Chin | |
| 2007/0132700 | A1 | 6/2007 | Cho et al. | |
| 2008/0219401 | A1 * | 9/2008 | Tobita | G09G 3/3677 377/79 |

FOREIGN PATENT DOCUMENTS

| | | | |
|---|---|---|---|
| CN | 101577106 | A | 11/2009 |
| CN | 202736457 | U | 2/2013 |

(Continued)

OTHER PUBLICATIONS

CN103928003 A Inventor: Zhou Xiufeng Published Date: Jul. 16, 2014 English Language Translation; (Year: 2014).*

(Continued)

*Primary Examiner* — Jennifer Mehmood
(74) *Attorney, Agent, or Firm* — Westman, Champlin & Koehler, P.A.

(57) ABSTRACT

The disclosure provides a gate driving circuit, an array substrate and a method for recovering the same. The gate driving circuit comprises: a plurality of cascaded shift registers; a recovering signal line and a first reference signal line, extending along an arrangement direction of the shift registers; and a plurality of recovering units, corresponding to the shift registers respectively. After determining a failed shift register in the gate driving circuit, the recovering unit replaces a signal outputted from the failed shift register with a first reference signal from the first reference signal line and loads the first reference signal to the corresponding gate line for recovering. Thus, compared with a structure of outputting the signal provided by the recovering signal line to the gate line, the gate driving circuit of the disclosure has a less significant attenuation on the signal outputted to the gate line.

12 Claims, 11 Drawing Sheets

(58) Field of Classification Search
CPC ..... G09G 2310/0286; G09G 2310/08; G09G 2330/12; G09G 2330/08; G09G 2330/10; G02F 2001/136254; G02F 1/136259; G02F 2203/69
See application file for complete search history.

(56) References Cited

FOREIGN PATENT DOCUMENTS

| | | | | |
|---|---|---|---|---|
| CN | 103928003 | A | * | 7/2014 |
| CN | 103928003 | A | | 7/2014 |
| KR | 20070055843 | A | | 5/2007 |
| TW | 201117163 | A | | 5/2011 |

OTHER PUBLICATIONS

First Office Action from Chinese Patent Application No. 201610124267.0, dated Nov. 1, 2017, 13 pages.

* cited by examiner

GATE DRIVING CIRCUIT, AN ARRAY SUBSTRATE AND A METHOD FOR RECOVERING THE SAME

CROSS-REFERENCE TO RELATED APPLICATIONS

This application claims the benefit of Chinese Patent Application No. 201610124267.0, filed on Mar. 4, 2016, in the State Intellectual Property Office of China, the whole disclosure of which is incorporated herein by reference.

TECHNICAL FIELD

The present disclosure relates to a field of display technology, and in particular, to a gate driving circuit, an array substrate and a method for recovering the same.

BACKGROUND

Flat panel displays generally use a gate driving circuit or a gate drive on array (GOA) consisting of a plurality of cascaded shift registers. Since characteristics of the GOA, when a shift register fails, a whole row of pixels which are connected with the failed shift register will turn into an abnormal display status, thereby causing a failed display panel. At this time, recovering of the failed shift register on an array substrate is required.

In a conventional GOA, a recovering signal line (Recover) which is connectable with each gate line (Gate) is added, as shown in FIG. 1*a* and FIG. 2*a*. When the shift register in a $(n+1)^{th}$ stage fails, recovering of the failed shift register is required. FIG. 1*b* and FIG. 2*b* show arrangements of a gate driving circuit after recovering the shift register in the $(n+1)^{th}$ stage respectively, in which "x" indicates for disconnecting, and "●" indicates for connecting. In particular, a recovering method shown in FIG. 1*b* is to disconnect a signal outputting terminal (Output) of the shift register in the $(n+1)^{th}$ stage from a corresponding gate line (Gate n+1), from a resetting signal terminal (Reset) of the shift register in a previous stage, and from a signal inputting terminal (Input) of the shift register in a next stage, and to connect a recovering signal line (Recover) to the gate line (Gate n+1). The recovering method shown in FIG. 2*b* is to disconnect the signal outputting terminal (Output) of the shift register in the $(n+1)^{th}$ stage from the Gate n+1, from the resetting signal terminal (Reset) of the shift register in a $n^{th}$ stage, and from the signal inputting terminal (Input) of the shift register in the $(n+2)^{th}$ stage, and to connect the recovering signal line (Recover) to a source of a recovering switch transistor (T n+1).

FIG. 3*a* shows a timing diagram before the recovering and FIG. 3*b* shows a timing diagram after the recovering. Since the recovering signal line (Recover) is throughout the whole GOA in the recovering methods discussed above, the recovering signal line (Recover) is connectable with all signal outputting terminals (Output), and thereby a parasitic capacitor may be generated at a connection point. Furthermore, the above recovering methods replace a signal outputted from the failed shift register by using the recovering signal line (Recover), thus a load of the whole row of pixels on the gate line connected with the recovering signal line (Recover) and the load at the connection point between the recovering signal line (Recover) and each signal outputting terminal (Output) will cause a serious attenuation of a signal transmitted on the recovering signal line (Recover), thereby affecting the recovering of the failed shift register.

SUMMARY

Therefore, embodiments of the present disclosure provide a gate driving circuit, an array substrate and a method for recovering the same.

In an aspect of the embodiments of the present disclosure, it is provided a gate driving circuit, comprising:

a plurality of cascaded shift registers, wherein each stage of the shift register has a signal outputting terminal connected with a corresponding gate line, and the signal outputting terminals of the rest stages of shift registers other than a shift register in a first stage and a shift register in a last stage are connected with a resetting signal terminal of the shift register in a previous stage and a signal inputting terminal of the shift register in a next stage, respectively;

a recovering signal line and a first reference signal line, extending along an arrangement direction of the plurality of cascaded shift registers; and a plurality of recovering units, corresponding to the plurality of cascaded shift registers respectively, wherein each recovering unit has a signal input connectable with the first reference signal line, a signal output connectable with the gate line corresponding to its corresponding shift register, and a signal control connectable with the recovering signal line; and upon recovering a failed shift register, the recovering unit corresponding to the failed shift register is configured to deliver a first reference signal provided from the first reference signal line to the corresponding gate line, under the control of the recovering signal line.

Preferably, each recovering unit may comprise a switch transistor, and the switch transistor has a gate as the signal control, a source as the signal input and a drain as the signal output.

Preferably, at least one of following conditions should be satisfied before recovering the failed shift register:

the signal input of each recovering unit is disconnected from the first reference signal line;

the signal output of each recovering unit is disconnected from the gate line; and the signal controlling end of each recovering unit is disconnected from the recovering signal line.

Preferably, the gate driving circuit according to the embodiments of the present disclosure may further comprise a second reference signal line extending alone the arrangement direction of the plurality of cascaded shift registers;

before recovering the failed shift register, the signal input of each recovering unit is configured to connect with the first reference signal line, the signal output of each recovering unit is configured to connect with the corresponding gate line, and the signal control of each recovering unit is configured to connect with the second reference signal line and disconnect from the recovering signal line; and after recovering the failed shift register, the signal control of the recovering unit corresponding to the failed shift register is configured to disconnect from the second reference signal line and connect with the recovering signal line.

Preferably, the recovering signal line and the plurality of recovering units may be arranged at a same one side of the signal outputting terminals of the shift registers.

Preferably, the gate driving circuit comprises one recovering signal line, which is connectable with each gate line; or the gate driving circuit comprises a plurality of the recovering signal lines, wherein each of recovering signal lines is connectable with a part of the gate lines.

Preferably, the first reference signal line may be arranged at the same one side of the signal outputting terminals of the shift registers, and disconnected from any signal line or any terminal other than the signal inputs of the recovering units.

In an another aspect of the embodiments of the disclosure, it is provided an array substrate, comprising at least one group of the gate driving circuits discussed above which are arranged in a non-displaying area; and gate lines which are arranged in a displaying area, wherein the gate lines correspond to a signal outputting terminal of each of the plurality of cascaded shift registers, respectively.

In an another aspect of the embodiments of the present disclosure, it is provided a method for recovering the array substrate discussed above, comprising:

determining a failed shift register in the gate driving circuit of the array substrate;

disconnecting the signal outputting terminal of the failed shift register from a corresponding gate line, from the resetting signal terminal of the shift register in a previous stage, and from the signal inputting terminal of shift register in a next stage; and enabling the signal control of the recovering unit corresponding to the failed shift register to be connected with the recovering signal line, enabling the signal input of the recovering unit to be connected with the first reference signal line, and enabling the signal output of the recovering unit to be connected with the corresponding gate line.

Preferably, the method may further comprise enabling the signal control of the recovering unit corresponding to the failed shift register to be disconnected from a second reference signal line.

DETAILED DESCRIPTION

Specific implementations of a gate driving circuit, an array substrate and a method for recovering the same according to embodiments of the present disclosure will be described in detail below in conjunction with accompanying drawings.

Figure 4A:
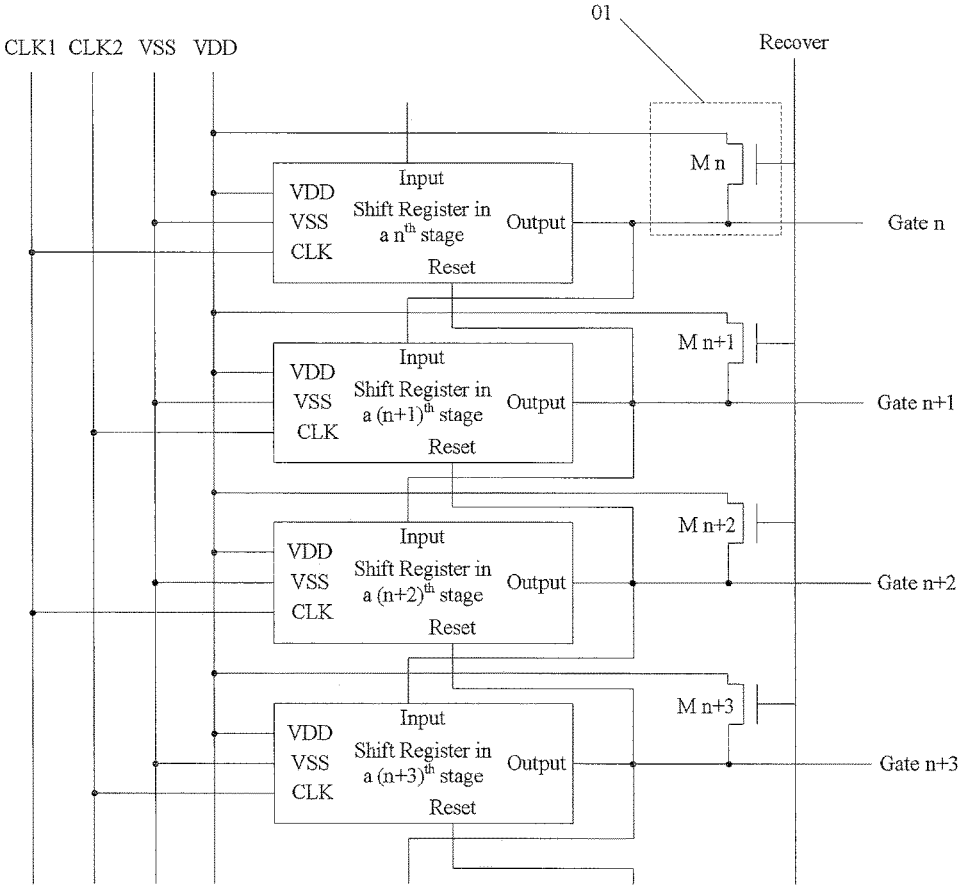
FIG. 4*a* is a schematic structural diagram illustrating a gate driving circuit before being recovered according to an embodiment of the present disclosure.
Figure 5A:
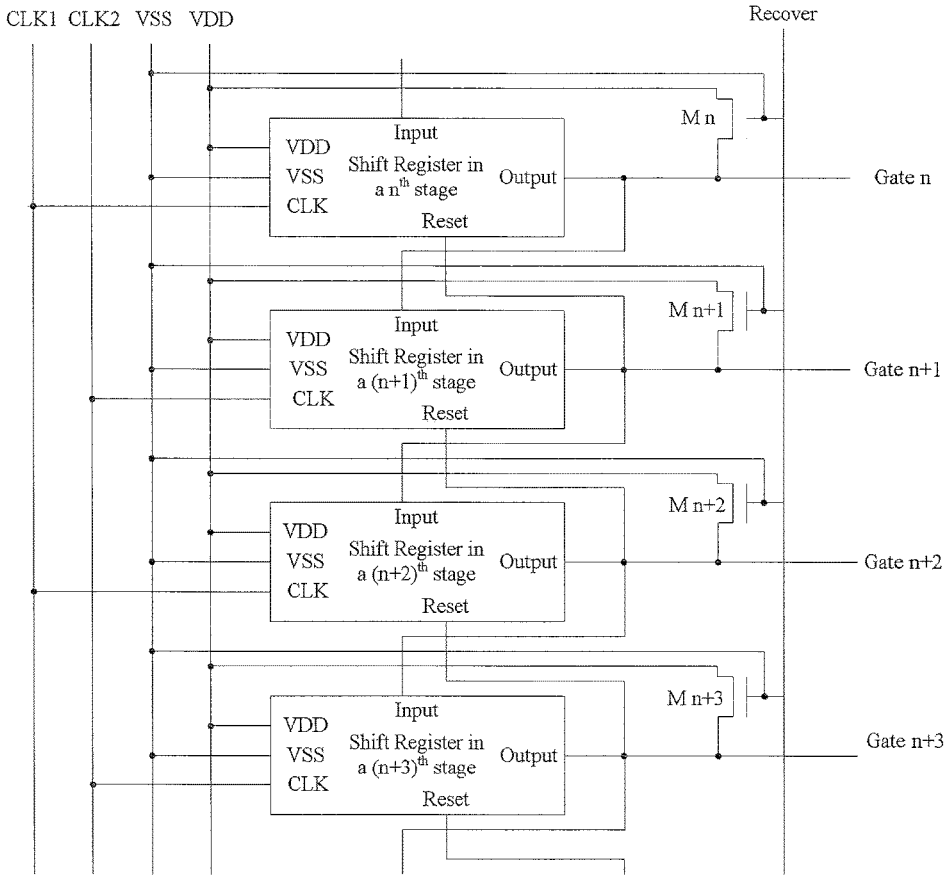
FIG. 5*a* is a schematic structural diagram illustrating another gate driving circuit before being recovered according to another embodiment of the present disclosure.
Figure 6:
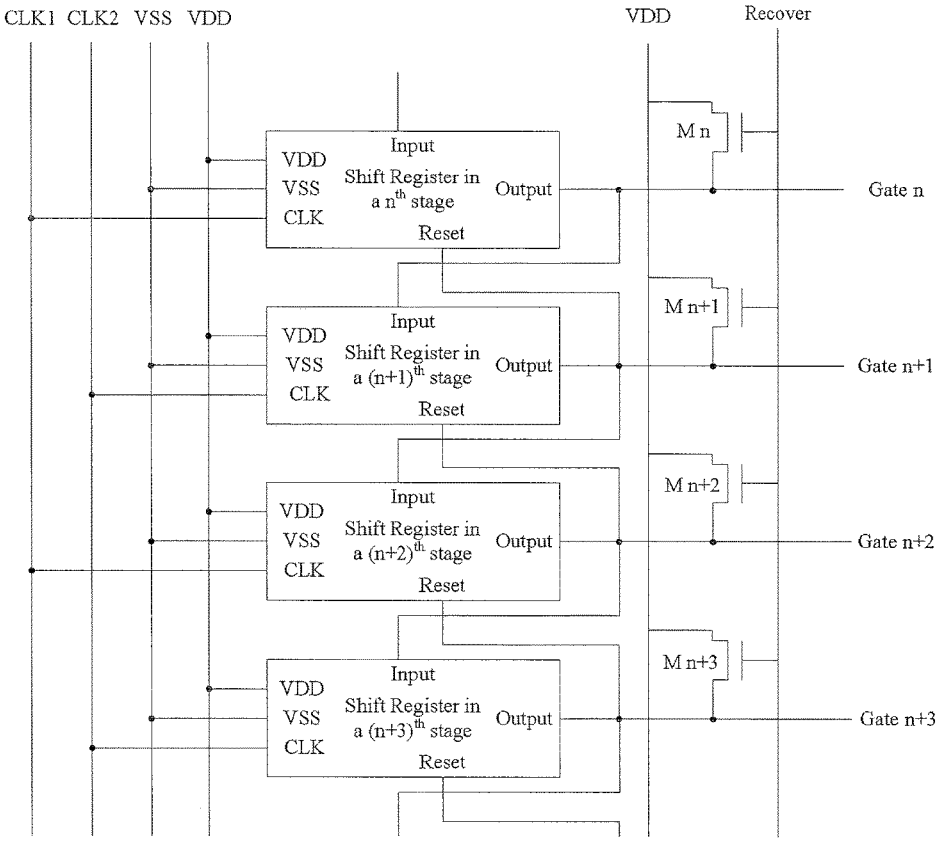
FIG. 6 is a schematic structural diagram illustrating still another gate driving circuit before being recovered according to still another embodiment of the present disclosure.

The embodiments of the disclosure may provide a gate driving circuit. As shown in FIGS. 4*a*, 5*a* and 6, the gate driving circuit may comprise a plurality of cascaded shift registers, wherein each stage of the shift register may have a signal outputting terminal (Output) connected with a corresponding gate line (Gate); and the signal outputting terminals (Output) of the rest stages of shift registers other than a shift register in a first stage and a shift register in a last stage are connected with a resetting signal terminal (Reset) of the shift register in a previous stage and a signal inputting terminal (Input) of the shift register in a next stage, respectively.

Figure 4B:
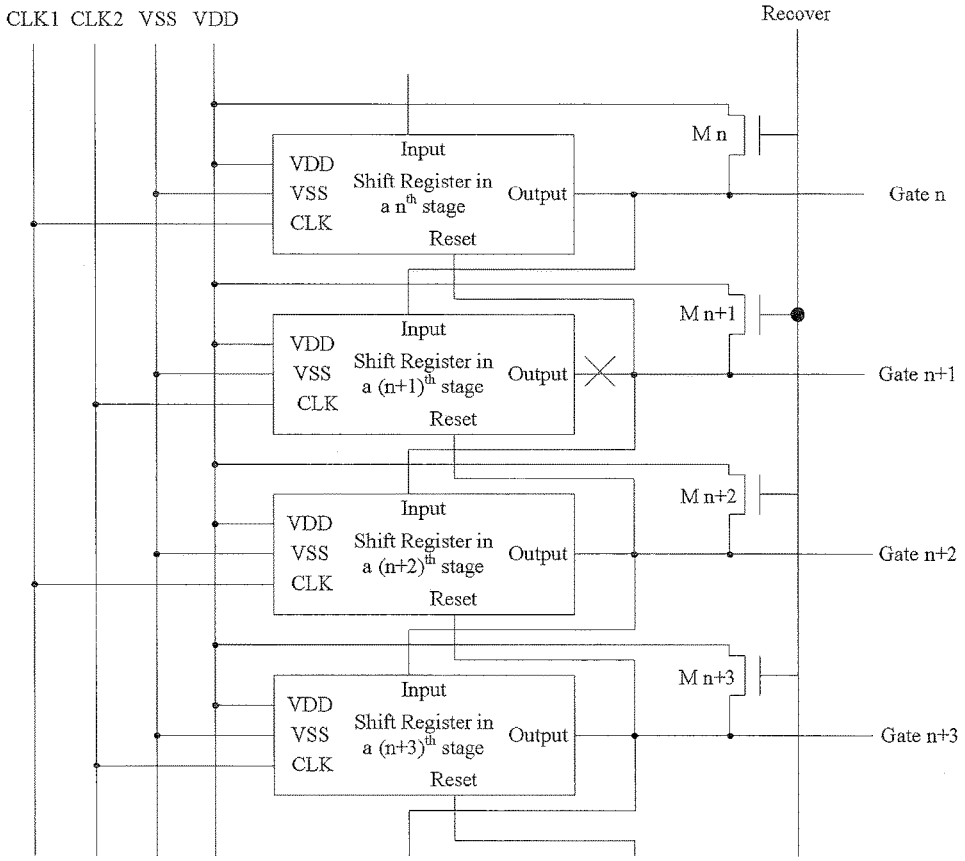
FIG. 4*b* is a schematic structural diagram illustrating the gate driving circuit shown in FIG. 4*a* after being recovered.
Figure 5B:
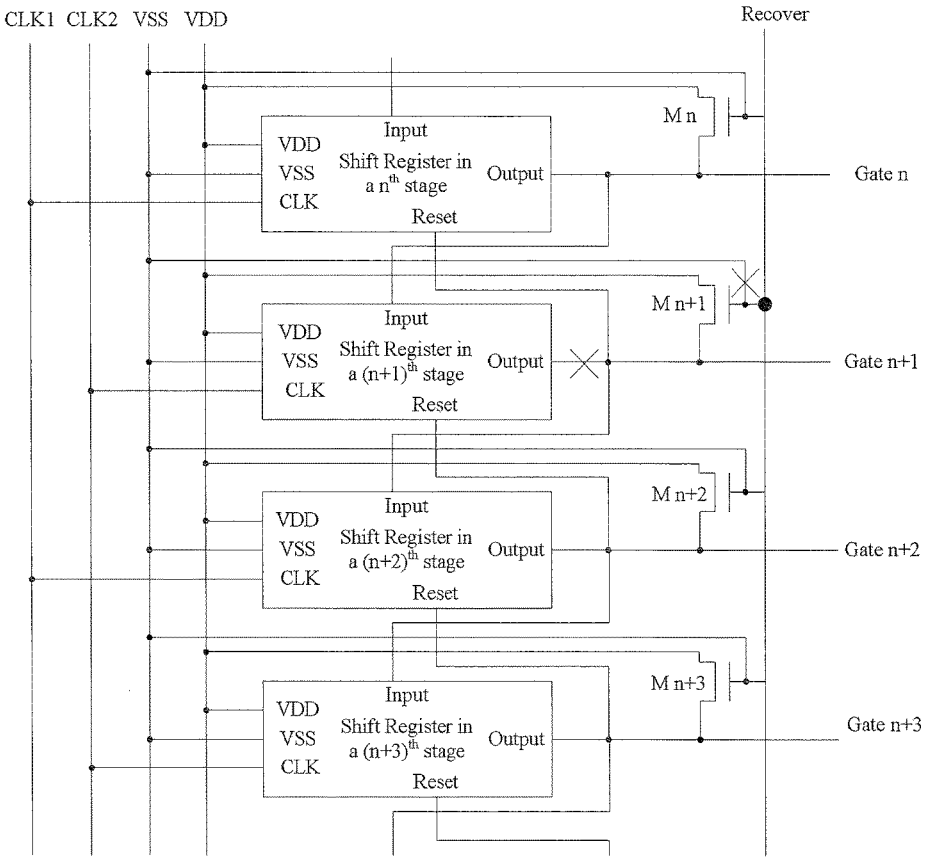
FIG. 5*b* is a schematic structural diagram illustrating the gate driving circuit shown in FIG. 5*a* after being recovered.

The gate driving circuit according to the embodiments of the present disclosure may further comprise: a recovering signal line (Recover) and a first reference signal line (VDD) extending along an arrangement direction of the plurality of cascaded shift registers. In other words, as shown in the drawings, the plurality of cascaded shift registers are arranged in a vertical direction, meanwhile the gate lines (Gate) are generally extended along a horizontal direction, thus the recovering signal line (Recover) and the first reference signal line (VDD) may extend alone the vertical direction;

a plurality of recovering units 01, corresponding to the plurality of cascaded shift register respectively, wherein each recovering unit 01 has a signal input connectable with the first reference signal line (VDD), a signal output connectable with the gate line (Gate) corresponding to its corresponding shift register, and a signal control connectable with the recovering signal line (Recover). As shown in FIGS. 4*b* and 5*b*, upon recovering a failed shift register, the recovering unit 01 corresponding to the failed shift register is further configured to deliver a first reference signal provided from the first reference signal line (VDD) to the gate line (Gate) connected with it, under the control of the recovering signal line (Recover).

It should be noted that FIGS. 4*a*, 5*a* and 6 are schematic diagrams of the gate driving circuits before being recovered; and FIGS. 4*b* and 5*b* are schematic diagrams of the gate driving circuits after being recovered. In the drawings, "x" indicates for disconnecting, and "●" indicates for connecting. Furthermore, in FIGS. 4*b* and 5*b*, the present disclosure is explained by taking the shift register in a $(n+1)^{th}$ stage being failed for an example.

Figure 1A:
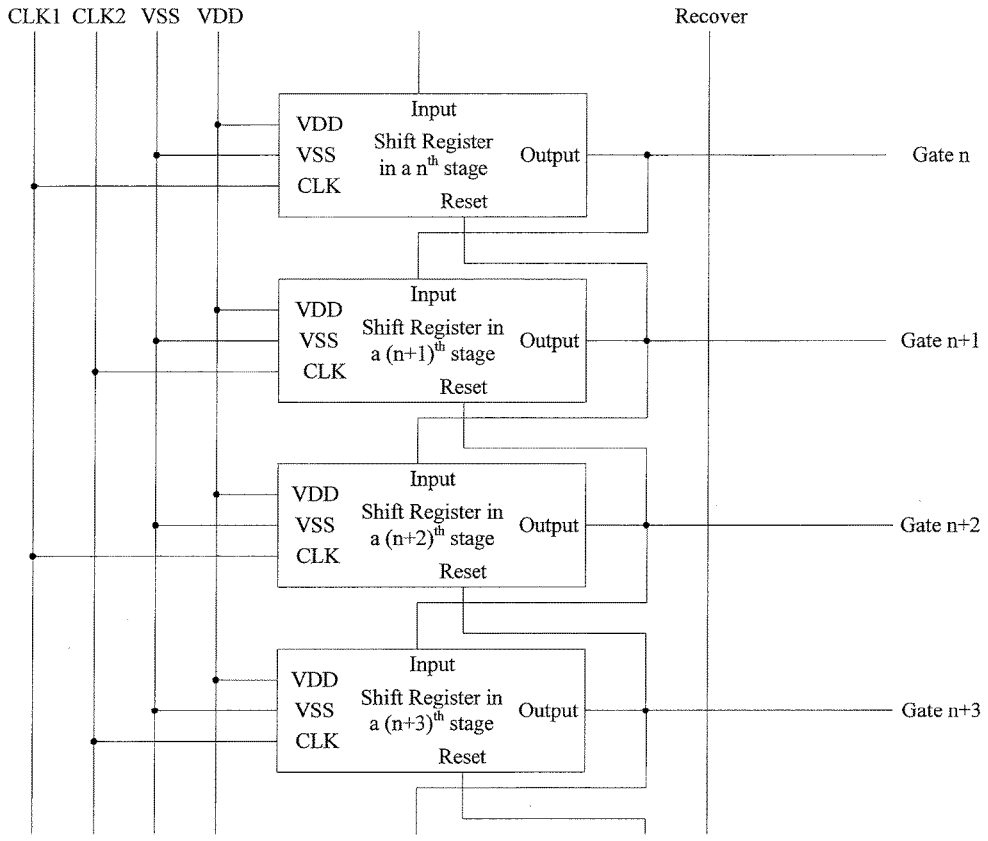
Prior Art Fig. 1a
FIG. 1*a* is a schematic structural diagram illustrating a conventional gate driving circuit before being recovered.
Figure 1B:
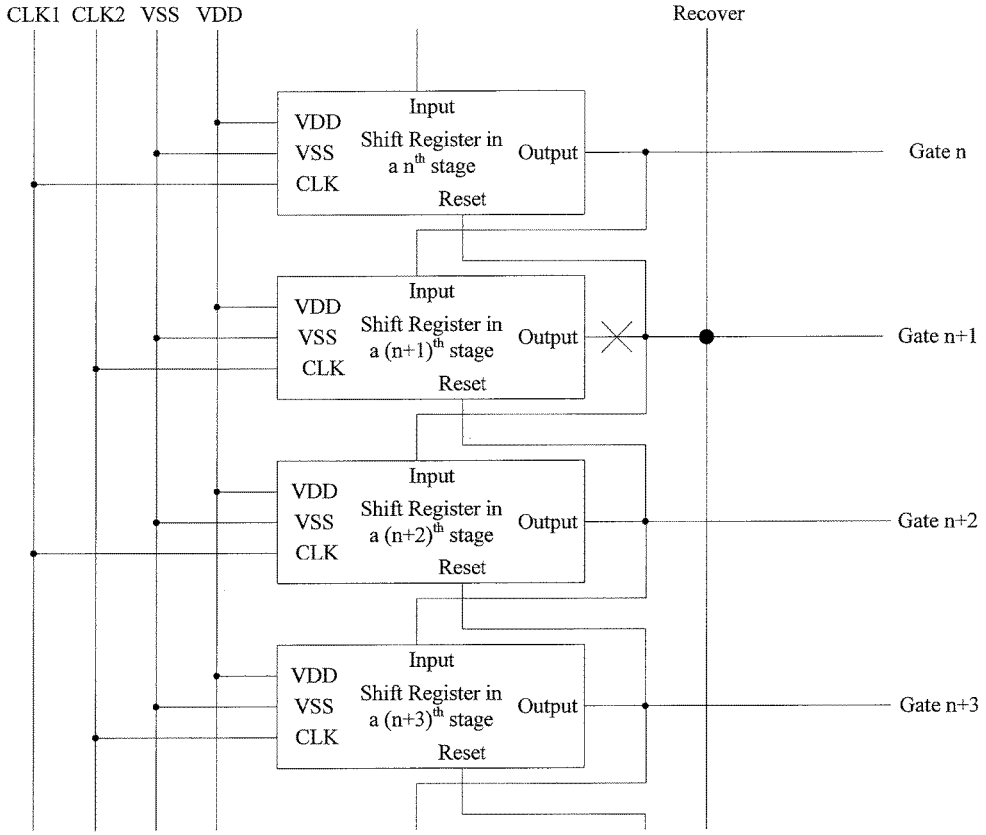
Prior Art Fig.1b
FIG. 1*b* is a schematic structural diagram illustrating the conventional gate driving circuit shown in FIG. 1*a* after being recovered.
Figure 2A:
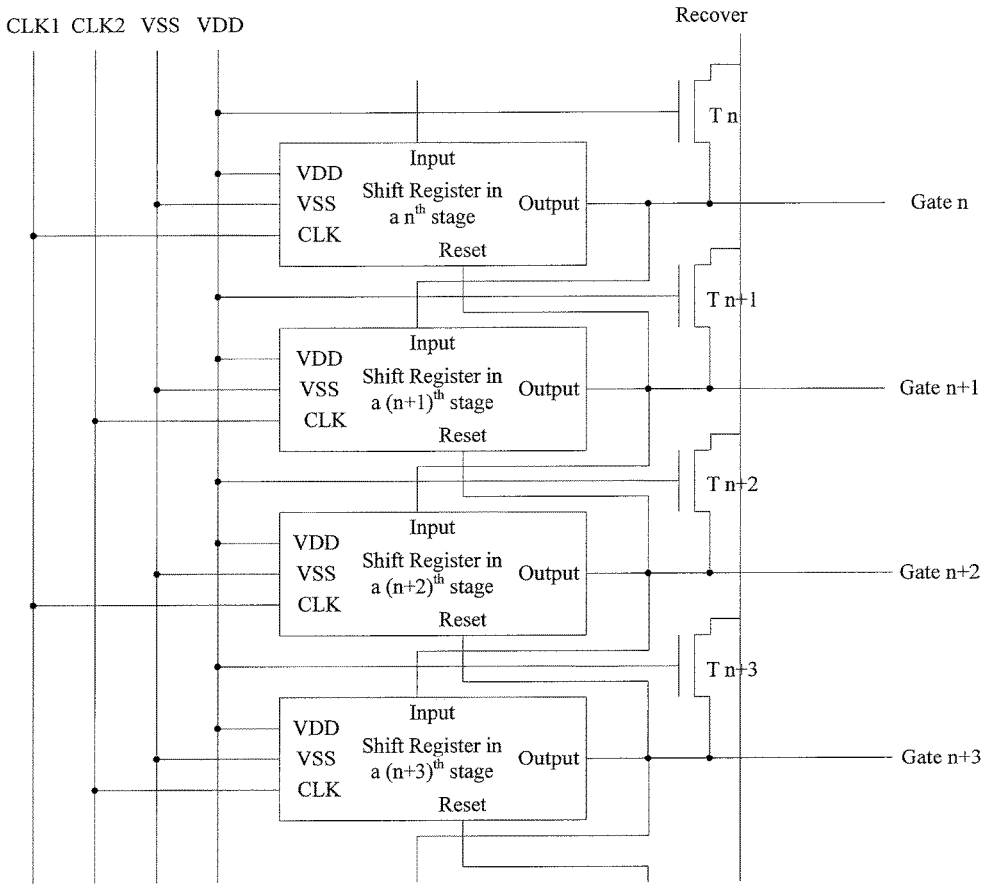
Prior Art Fig. 2a
FIG. 2*a* is a schematic structural diagram illustrating another conventional gate driving circuit before being recovered.
Figure 2B:
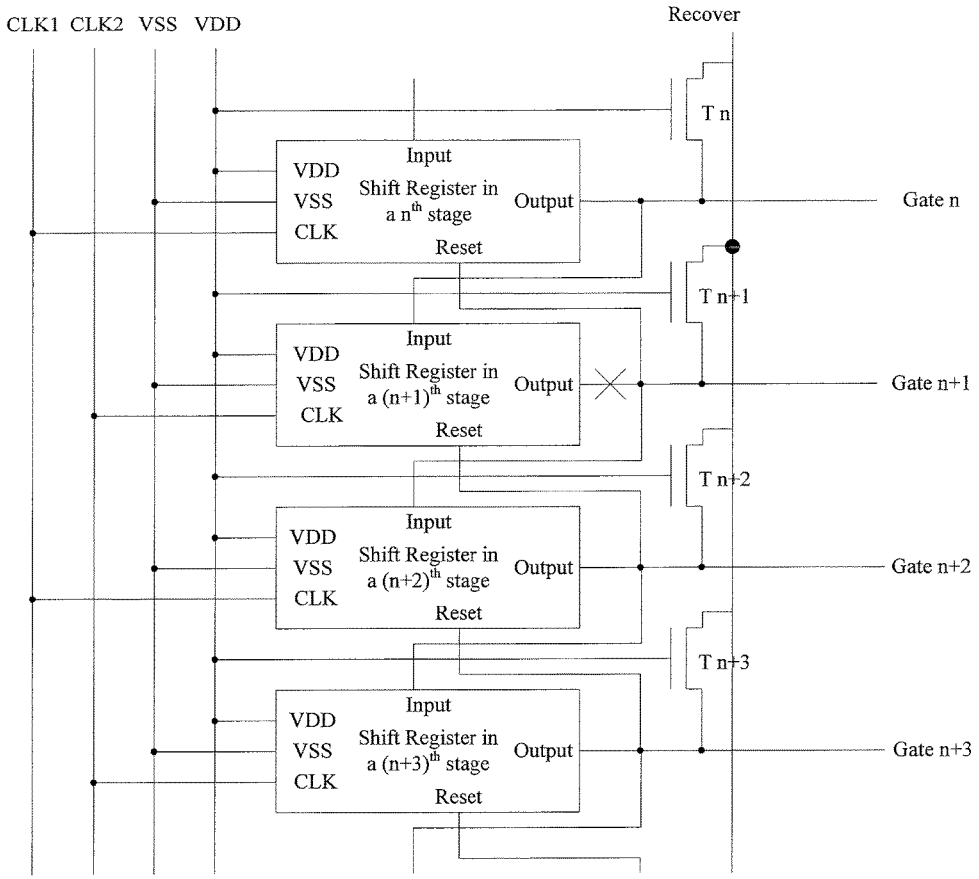
Prior Art Fig. 2b
FIG. 2*b* is a schematic structural diagram illustrating the conventional gate driving circuit shown in FIG. 2*a* after being recovered.
Figure 3A:
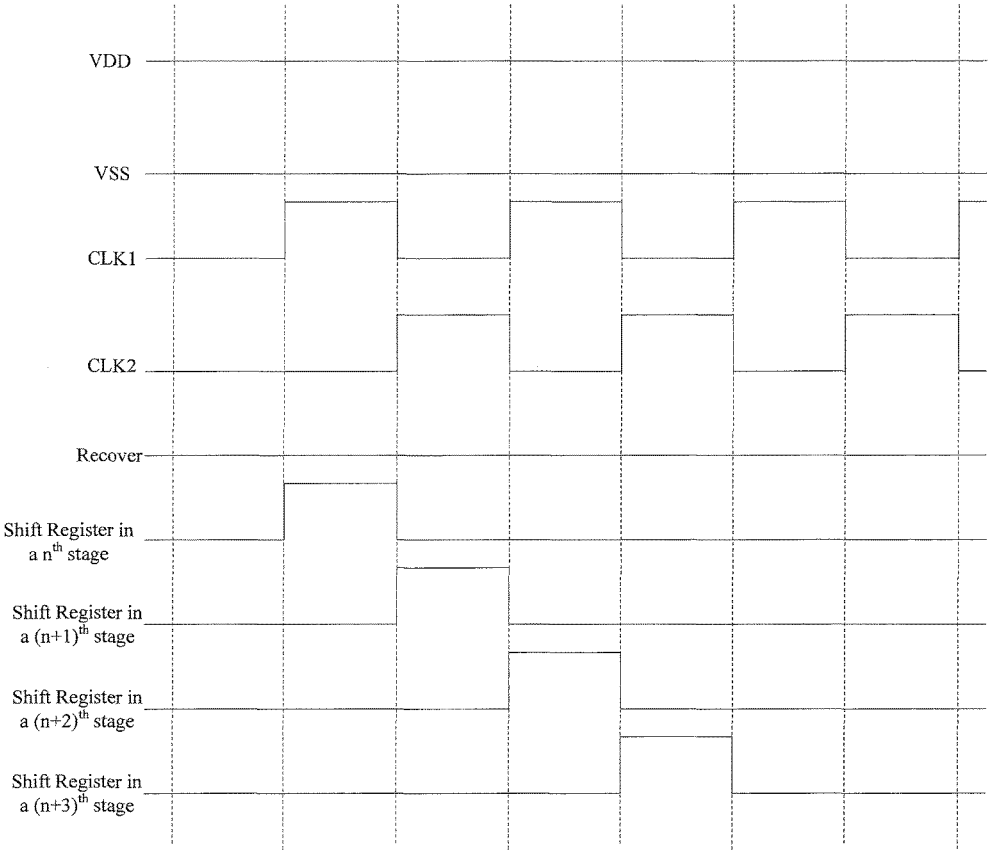
Prior Art Fig. 3a
FIG. 3*a* is a timing diagram of the gate driving circuit before being recovered shown in FIGS. 1*a* and 2*a;*
Figure 3B:
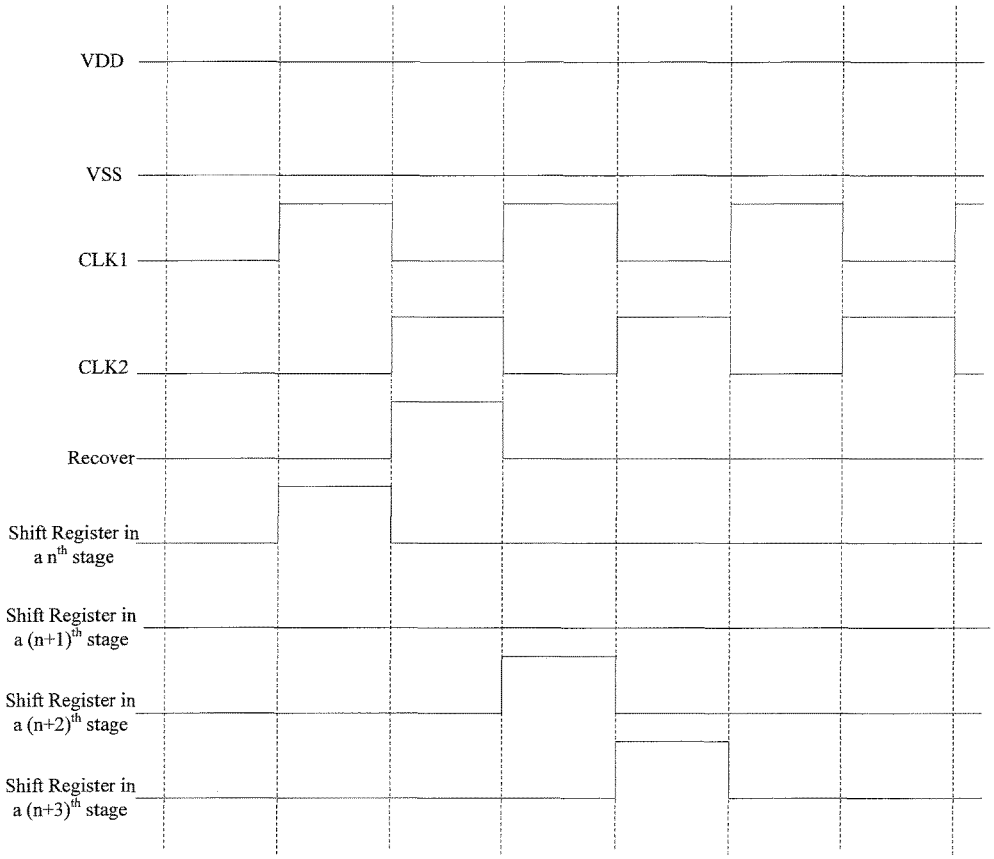
Prior Art Fig. 3b
FIG. 3*b* is a timing diagram of the gate driving circuit after being recovered shown in FIGS. 1*b* and 2*b;*

In the gate driving circuit according to the embodiments of the present disclosure, since a parasitic capacitor generated at a connection point between the recovering signal line (Recover) and the signal outputting terminal (Output) of each shift register only affects a signal loaded on the signal control of the recovering unit 01, and a signal outputted to the gate line (Gate) is a first reference signal provided by the first reference signal line (VDD) which is usually a direct current (DC) signal, compared with the conventional structure of outputting the signal provided by the recovering signal line (Recover) to the gate line (Gate) as shown in FIGS. 1*b* and 2*b*, the gate driving circuit according to the embodiments of the present disclosure may have a relatively less significant attenuation on the signal outputted to the gate line (Gate), and thus has a better recovering effect.

As shown in FIG. 4*a*, each recovering unit in the shift register may comprise a switch transistor M, wherein the switch transistor M has a gate as the signal control, a source as the signal input and a drain as the signal output.

It should be noted that the switch transistor mentioned above may be a thin film transistor (TFT) or a metal oxide semiconductor (MOS), which is not limited herein. In an implementation, the source and the drain of the switch transistor may have interchangeable functions according to different types of the transistors and different inputting signals, and thus are not specifically distinguished here.

In addition, the switch transistors comprised in the above gate driving circuit are usually made of a same material as the switch transistors in the shift register. In an implementation, in order to simplify the process, the switch transistors comprised in the recovering units may be a P-type transistors or a N-type transistor.

In an implementation of the gate driving circuit according to the embodiments of the present disclosure, in order to enable the recovering units 01 having no effect on the signal of the gate line (Gate) during the operation of each shift register, as shown in FIGS. 4*a* and 6, at least one of following conditions or a combination thereof may be satisfied before recovering the failed shift register:

a. the signal input of each recovering unit 01 is disconnected (i.e. insulated) from the first reference signal line (VDD);

b. the signal output of each recovering unit 01 is disconnected from the gate line (Gate); and c. the signal control of each recovering unit 01 is disconnected from the recovering signal line (Recover).

FIG. 4*a* shows an arrangement when the condition c is satisfied. Correspondingly, as shown in FIG. 4*b*, in recovering the shift register, the signal control of the recovering unit 01 should be connected with the recovering signal line (Recover). FIG. 6 shows a case that the conditions a and c are both satisfied, and in recovering the shift register, the signal control of the recovering unit 01 should be connected with the recovering signal line (Recover), meanwhile the signal input of the recovering unit 01 should be connected with the first reference signal line (VDD).

In addition, as shown in FIGS. 5*a* and 5*b*, the above gate driving circuit according to the embodiments of the disclosure may further comprise a second reference signal line (VSS) extending along the arrangement direction of the plurality of cascaded shift registers.

As shown in FIG. 5*a*, before recovering the failed shift register, the signal input of each recovering unit 01 may be connected with the first reference signal line (VDD), the signal output of each recovering unit 01 may be connected with the corresponding gate line (Gate), and the signal control of each recovering unit 01 is configured to connect with the second reference signal line (VSS) and disconnect from the recovering signal line (Recover). Thus, when no recovering is required, each recovering unit 01 can be turned off perfectly, so as to avoid affecting the signal on the gate line (Gate), and thus to avoid affecting the displaying of images.

As shown in FIG. 5*b*, after recovering the failed shift register, the signal control of the recovering unit 01 corresponding to the failed shift register is configured to disconnect from the second reference signal line (VSS) and connect with the recovering signal line (Recover).

In an implementation, in order to facilitate wiring of the above gate driving circuit, as shown in FIGS. 4*a*, 5*a* and 5, the recovering signal line (Recover) and each recovering unit 01 are normally arranged at a same one side of the signal outputting terminals (Output) of the shift registers.

Furthermore, the gate driving circuit according to the embodiments of the disclosure may comprise one or more recovering signal lines (Recover). In a case that the gate driving circuit comprises one recovering signal line (Recover), the recovering signal line (Recover) may be connectable with each gate line (Gate). In this case, the wiring of the gate driving circuit may be simplified, but only one failed shift register can be recovered at a time. In another case, when the gate driving circuit comprises a plurality of recovering signal lines (Recover), each of the plurality of recovering signal lines (Recover) may be connectable with a part of the gate lines (Gate). At this time, the wiring of the gate driving circuit may be complicated, but several failed shift registers can be recovered at a same time.

Preferably, in the gate driving circuit according to the embodiments of the disclosure, as shown in FIG. 6, the first reference signal line (VDD) is arranged at the same one side of the signal outputting terminals (Output) of the shift registers, and disconnected from any signal line or any terminal other than the signal inputs of the recovering units 01, so as to avoid generating a parasitic capacitor at the connection point between the first reference signal line (VDD) and other signal line or terminal which will attenuate the first reference signal and affect the recovering of the failed shift register.

Furthermore, as shown in FIGS. 4*a* and 5*a*, the first reference signal line (VDD) is also connectable with the first reference signal terminal (VDD) of each shift register. Alternatively, as shown in FIG. 6, another first reference signal line (VDD) is separately provided to deliver the first reference signal to the first reference signal terminal (VDD) of each shift register, which is not limited herein.

Based on the same inventive concept, the embodiments of the present disclosure further provide an array substrate, comprising at least one group of the gate driving circuits discussed above which are arranged in a non-displaying area; and gate lines which are arranged in a displaying area, wherein the gate lines correspond to a signal outputting terminal of each of the plurality of cascaded shift registers, respectively. Since the principle of the array substrate is similar with the principle of the gate driving circuit, a specific implementation of the array substrate may be also known with reference to the description of the gate driving circuit described above, and the same content will no longer be repeated.

Based on the same inventive concept, the embodiments of the disclosure provide a method for recovering the array substrate discussed above, comprising:

firstly, determining a failed shift register in the gate driving circuit of the array substrate;

then, as shown in FIGS. 4*b* and 5*b*, disconnecting the signal outputting terminal of the failed shift register from a corresponding gate line, from the resetting signal terminal of the shift register in a previous stage, and from the signal inputting terminal of shift register in a next stage; and subsequently, as shown in FIGS. 4*b* and 5*b*, enabling the signal control of the recovering unit corresponding to the failed shift register to be connected with the recovering signal line, enabling the signal input of the recovering unit to be connected with the first reference signal line, and enabling the signal output of the recovering unit to be connected with the corresponding gate line. In an implementation, upon recovering the failed shift register, if it is connected at the connection point, no operation is required. Otherwise, a welding process is required to be performed at the connection point. A specific implementation of the welding process may be also known with reference to a welding process with lasers.

In addition, as shown in FIG. 5*b*, if the second reference signal line (VSS) which is connectable with the signal control of each recovering unit exists, the method according to the embodiments of the present disclosure may further comprise: enabling the signal control of the recovering unit corresponding to the failed shift register to be disconnected from a second reference signal line.

The embodiments of the present disclosure may provide a gate driving circuit, an array substrate and a method for recovering the same. The gate driving circuit may comprise: a plurality of cascaded shift registers; a recovering signal line and a first reference signal line, arranged to extend along an arrangement direction of the plurality of cascaded shift registers; and a plurality of recovering units, corresponding to the plurality of cascaded shift registers respectively, wherein each recovering unit has a signal input connectable with the first reference signal line, a signal output connectable with the gate line corresponding to its corresponding shift register, and a signal control connectable with the recovering signal line. In a case that a failed shift register in the gate driving circuit of the array substrate is determined, when enabling the signal control of the recovering unit corresponding to the failed shift register to be connected with the recovering signal line, enabling the signal input of the recovering unit to be connected with the first reference signal line, and enabling the signal output of the recovering unit to be connected with the corresponding gate line, the signal outputted from the shift register is replaced with the first reference signal from the first reference signal line, and the first reference signal is loaded to the gate line for recovering the failed shift register. Since a parasitic capacitor generated at the connection point between the recovering signal line and the signal outputting terminal of each shift register only affects the signal loaded on the signal control of the recovering unit, and the signal outputted to the gate line is the first reference signal provided by the first reference signal line which is usually a direct current (DC) signal, compared with the method of outputting the signal provided by the recovering signal line to the gate line, the method according to the embodiments of the present disclosure has a relatively less significant attenuation on the signal outputted to the gate line, and thus has a better recovering effect.

Obviously, those skilled in the art can make various modifications and variations to the present disclosure without departing from the spirit and scope of the present disclosure. Thus, if these modifications and variations of the present disclosure belong to the scope of the claims of the present disclosure and the equivalent technologies thereof, the present disclosure is also intended to include these modifications and variations.

We claim:

1. A gate driving circuit, comprising:

a plurality of cascaded shift registers, wherein each stage of the shift register has a signal outputting terminal connected with a corresponding gate line, and the signal outputting terminals of the rest stages of shift registers other than a shift register in a first stage and a shift register in a last stage are connected with a resetting signal terminal of the shift register in a previous stage and a signal inputting terminal of the shift register in a next stage, respectively;

a recovering signal line for providing a recovering signal and a first reference signal line for providing a first reference signal, extending along an arrangement direction of the plurality of cascaded shift registers; and a plurality of recovering units, provided corresponding to the plurality of cascaded shift registers respectively, wherein each recovering unit has a signal input connectable with the first reference signal line, a signal output connectable with the gate line corresponding to its corresponding shift register, and a signal control connectable with the recovering signal line;

wherein upon recovering a failed shift register, the recovering unit provided corresponding to the failed shift register is configured to deliver the first reference signal to a corresponding gate line for the failed shift register, under the control of the recovering signal; and wherein the first reference signal line is arranged at the same one side of the signal outputting terminals of the shift registers, and disconnected from any signal line or any terminal other than signal inputs of the recovering units.

2. The gate driving circuit of claim 1, wherein each recovering unit comprises a switch transistor, wherein the switch transistor has a gate as the signal control, a source as the signal input and a drain as the signal output.

3. The gate driving circuit of claim 2, wherein at least one of following conditions is satisfied before recovering the failed shift register:

the signal input of each recovering unit is disconnected from the first reference signal line;

the signal output of each recovering unit is disconnected from the gate line; and the signal control of each recovering unit is disconnected from the recovering signal line.

4. The gate driving circuit of claim 3, wherein the recovering signal line and the plurality of recovering units are arranged at a same one side of the signal outputting terminals of the shift registers.

5. The gate driving circuit of claim 4, wherein the gate driving circuit comprises one recovering signal line, which is connectable with each gate line; or the gate driving circuit comprises a plurality of the recovering signal lines, wherein each of recovering signal lines is connectable with a part of the gate lines.

6. An array substrate, comprising at least one group of the gate driving circuits of claim 1 arranged in a non-displaying area; and gate lines arranged in a displaying area, wherein the gate lines correspond to a signal outputting terminal of each of the plurality of cascaded shift registers, respectively.

7. A method for recovering the array substrate of claim 6, comprising:

determining a failed shift register in the gate driving circuit of the array substrate;

disconnecting the signal outputting terminal of the failed shift register from a corresponding gate line for the failed shift register, from the resetting signal terminal of the shift register in a previous stage, and from the signal inputting terminal of the shift register in a next stage; and enabling the signal control of the recovering unit corresponding to the failed shift register to be connected with the recovering signal line, enabling the signal input of the recovering unit to be connected with the first reference signal line, and enabling the signal output of the recovering unit to be connected with the corresponding gate line for the failed shift register.

8. The method of claim 7, further comprising:

enabling the signal control of the recovering unit corresponding to the failed shift register to be disconnected from a second reference signal line.

9. The gate driving circuit of claim 1, further comprising a second reference signal line extending along the arrangement direction of the plurality of cascaded shift registers;

before recovering the failed shift register, the signal input of each recovering unit is configured to connect with the first reference signal line, the signal output of each recovering unit is configured to connect with the corresponding gate line, and the signal control of each recovering unit is configured to connect with the second reference signal line and disconnect from the recovering signal line; and after recovering the failed shift register, the signal control of the recovering unit corresponding to the failed shift register is configured to disconnect from the second reference signal line and connect with the recovering signal line.

10. The gate driving circuit of claim 9, wherein the recovering signal line and the plurality of recovering units are arranged at a same one side of the signal outputting terminals of the shift registers.

11. The gate driving circuit of claim 10, wherein the gate driving circuit comprises one recovering signal line, which connectable with each gate line; or the gate driving circuit comprises a plurality of the recovering signal lines, wherein each of recovering signal lines is connectable with part of the gate lines.

12. The gate driving circuit of claim 10, wherein the first reference signal line is arranged at the same one side of the signal outputting terminals of the shift registers, and disconnected from any signal line or any terminal other than the signal inputs of the recovering units.

* * * * *